US007077277B2

(12) United States Patent
Wang

(10) Patent No.: US 7,077,277 B2
(45) Date of Patent: Jul. 18, 2006

(54) FOOT ASSEMBLY OF A CLOTHES RACK

(76) Inventor: Chi-Chung Wang, No. 38, Singye Rd., Dalio Hsiang, Koahsiung (TW)

( * ) Notice: Subject to any disclaimer, the term of this patent is extended or adjusted under 35 U.S.C. 154(b) by 135 days.

(21) Appl. No.: 10/952,341

(22) Filed: Sep. 27, 2004

(65) Prior Publication Data

US 2006/0065615 A1 Mar. 30, 2006

(51) Int. Cl.
*A47B 46/00* (2006.01)
*F16B 12/40* (2006.01)

(52) U.S. Cl. ..... 211/206; 211/123; 211/204; 211/207; 403/62; 403/65; 403/113; 403/117; 403/329; 403/330; 182/186.7; 182/186.8; 280/79.3; 52/655.1

(58) Field of Classification Search ..... 211/204, 211/206, 207, 123, 105.1, 199, 189; 403/62, 403/64, 65, 112, 113, 117, 326; 16/47, 18; 280/79.3; 182/186.8; 52/655.1; 297/116, 297/117, 312, 56, 58
See application file for complete search history.

(56) References Cited

U.S. PATENT DOCUMENTS 2,893,568 A * 7/1959 Scholz ..... 211/204
3,503,525 A * 3/1970 Loebner ..... 211/206
3,832,075 A * 8/1974 Arai ..... 403/328
4,726,552 A * 2/1988 Warshawsky ..... 248/122.1
5,342,137 A * 8/1994 Peng ..... 403/164
5,617,962 A * 4/1997 Chen ..... 211/206
5,660,637 A * 8/1997 Dodge ..... 118/500
5,718,344 A * 2/1998 Joldeson et al. ..... 211/206
6,401,948 B1 * 6/2002 Huang ..... 211/206
6,745,909 B1 * 6/2004 Lai ..... 211/206
6,761,274 B1 * 7/2004 Chen ..... 211/207

* cited by examiner

*Primary Examiner*—Richard E. Chilcot, Jr.
*Assistant Examiner*—Jared W. Newton
(74) *Attorney, Agent, or Firm*—Dellett & Walters

(57) ABSTRACT

A foot assembly includes two first legs each having a first ring provided with a first limiting recess defined in an inner face of the first ring and a first finger extending from the inner face of the first ring, two second legs each having a second ring and a second limiting recess defined in an inner face of the second ring to movably receive therein the first finger of the first ring and two joints each having a third ring, a tube and a tubular extension formed on a bottom rim of the third ring to extend into the first ring and the second ring. The joint has a second finger to be movably received in the first limiting recess such that the first leg is able to align with the second leg for storage.

6 Claims, 6 Drawing Sheets

FOOT ASSEMBLY OF A CLOTHES RACK

BACKGROUND OF THE INVENTION

1. Field of the Invention

The present invention relates to a foot assembly, and more particularly to the foot assembly of a clothes rack to reduce occupied space when the rack is stored.

2. Description of Related Art

With reference to FIG. 6, a conventional clothes rack (6) is shown and has two opposite poles (60), a crossbar (70) securely connected to distal ends of the two poles (60) and two foot assemblies (80) respectively and securely connected to proximal ends of the two poles (60). Each foot assembly (80) has a first connector (81) and a second connector (82) formed on the foot assembly (80). The second connector (82) is to receive the proximal end of the pole (60) and the first connector (81) is to receive a distal end of a base bar (71). Two casters (83) are respectively mounted on opposed sides of each of the foot assemblies (80) to facilitate movement of the clothes rack (6). As shown in the drawing, it is noted that the foot assembly (80) except the casters (83) is integrally molded so that it is impossible to fold the clothes rack (6) when required. Therefore, the clothes rack (6) takes up a large space when in storage.

Because the living space in metropolitan areas is reducing due to continuous infrastructure development, how to effectively use the available space becomes an art for modern people. Therefore, the conventional clothes rack is obsolete and improvement is required.

To overcome the shortcomings, the present invention tends to provide an improved clothes rack to mitigate the aforementioned problems.

SUMMARY OF THE INVENTION

The primary objective of the present invention is to provide an improved foot assembly of a clothes rack. The foot assembly is able to be folded such that storage space required for the clothes rack is compact.

Other objects, advantages and novel features of the invention will become more apparent from the following detailed description when taken in conjunction with the accompanying drawings.

DETAILED DESCRIPTION OF THE PREFERRED EMBODIMENT

Figure 1:
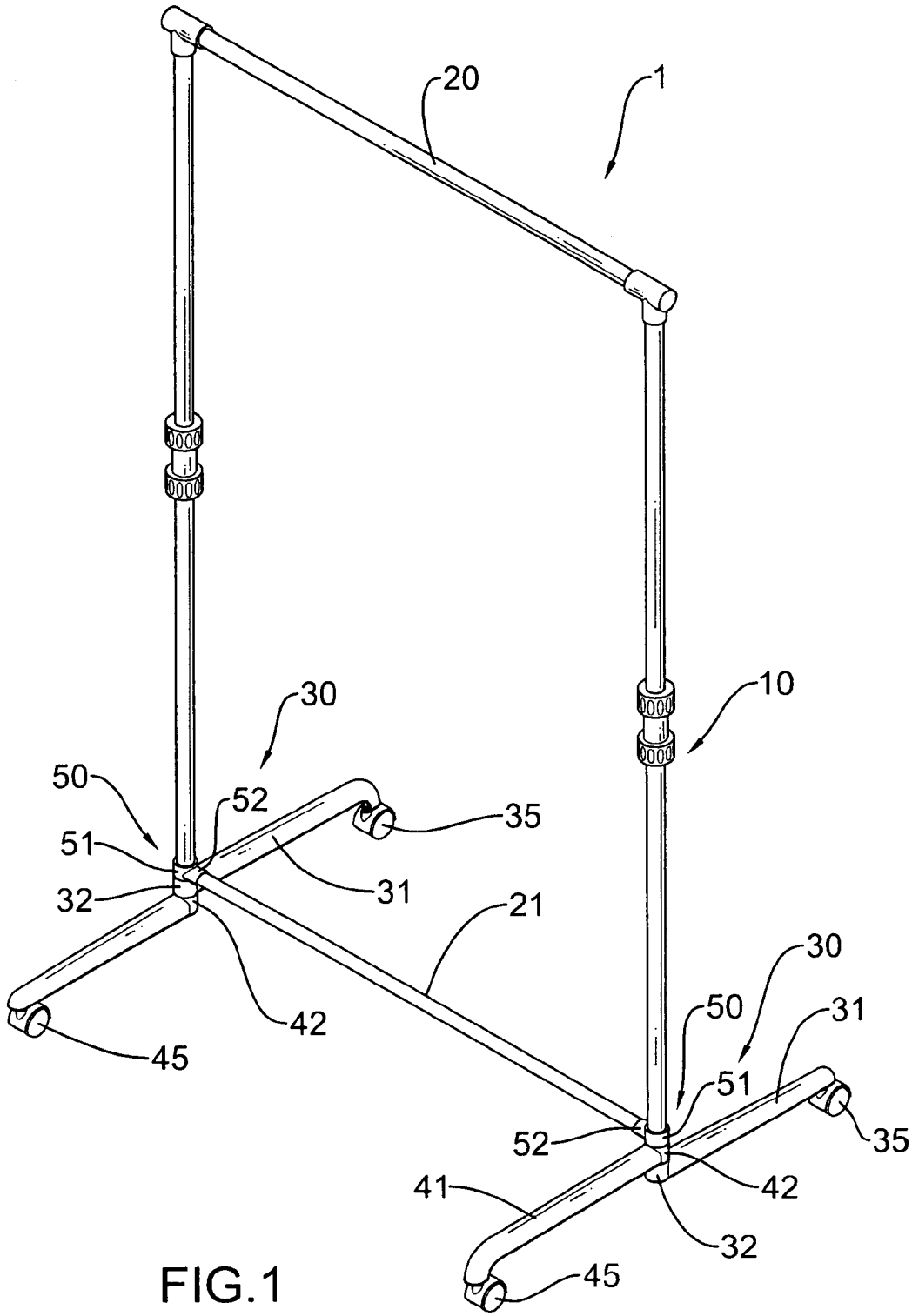
FIG. 1 is a perspective view of the clothes rack with the foot assembly of the present invention.
Figure 2:
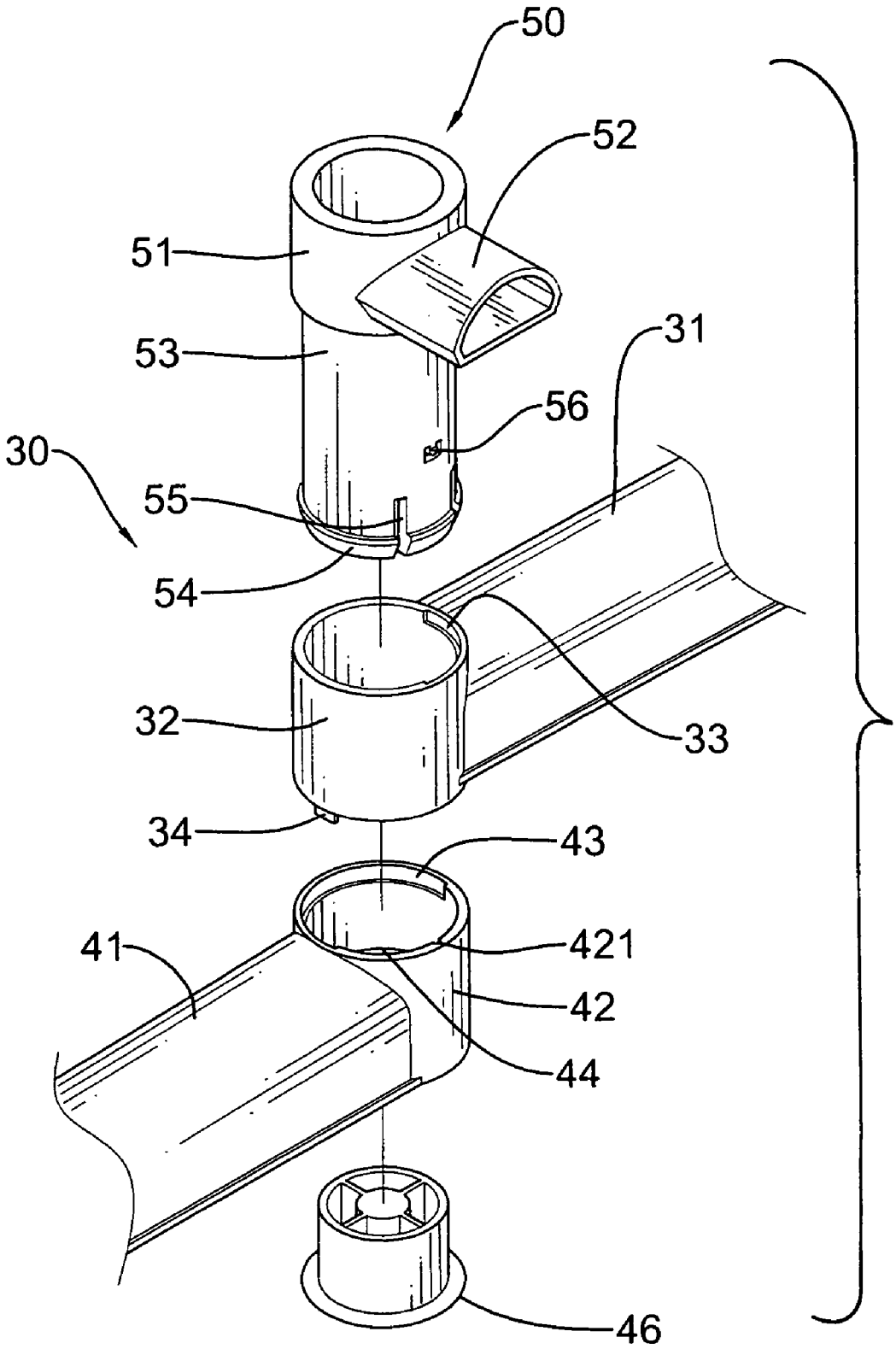
FIG. 2 is an exploded perspective view of the foot assembly of the present invention.

With reference to FIGS. 1 and 2, the clothes rack (1) in accordance with the present invention includes a top crossbar (20), a bottom crossbar (21) and two stanchions (10) respectively sandwiched between two opposite ends of the top crossbar (20) and the bottom crossbar (21). A foot assembly (30) is extended from a joint between the stanchion (10) and the bottom crossbar (21). The foot assembly (30) has a first leg (31) and a second leg (41) extending in a direction opposite to that of the first leg (31). A joint (50) is provided between the first leg (31) and the second leg (41).

The first leg (31) has a first ring (32) formed on a proximal end thereof and a first caster (35) rotatably mounted on a distal end thereof. The first leg (31) has a first limiting recess (33) defined in an inner face of the first ring (32) at a top opening and a first finger (34) extending from the inner face of the first ring (32) at a bottom opening. The second leg (41) has a second ring (42) formed on a proximal end thereof and a second caster (45) rotatably mounted on a distal end thereof. The second leg (41) has a second limiting recess (43) defined in an inner face of the second ring (42) at a top opening and a shoulder (44) formed on the inner face of the second ring (42), also at the top opening. A slit (421) is defined in the inner face of the second ring (42) and plug (46) is provided to extend into a bottom opening of the second ring (42) of the second leg (41).

The joint (50) is composed of a third ring (51), a tube (52) extending from an outer periphery of the third ring (51) to receive one end of the bottom crossbar (21) and a tubular extension (53) integrally extending out from a bottom rim of the third ring (51). The tubular extension (53) is provided with a flange (54) on a bottom rim of the tubular extension (53), multiple cutouts (55) longitudinally defined through a peripheral edge of the tubular extension (53) as well as the flange (54), a positioning boss (56) extending into an interior of the tubular extension by piercing and a second finger (57) (shown in FIG. 3) extending from an inner face of the tubular extension (53). The tubular extension (53) has an outer diameter smaller than that of the third ring (51) and an inner diameter the same as that of the third ring (51) to allow extension of the stanchion (10) into the tubular extension (53). Due to the definition of the cutouts (55) in the tubular extension (53), the bottom end of the tubular extension (53) is able to be deformed when encountering a resistance.

It is to be noted that the first limiting recess (33) is defined in 90 degrees in the first ring (32) and the second limiting recess (43) is defined in 180 degrees in the second ring (42).

Figure 3:
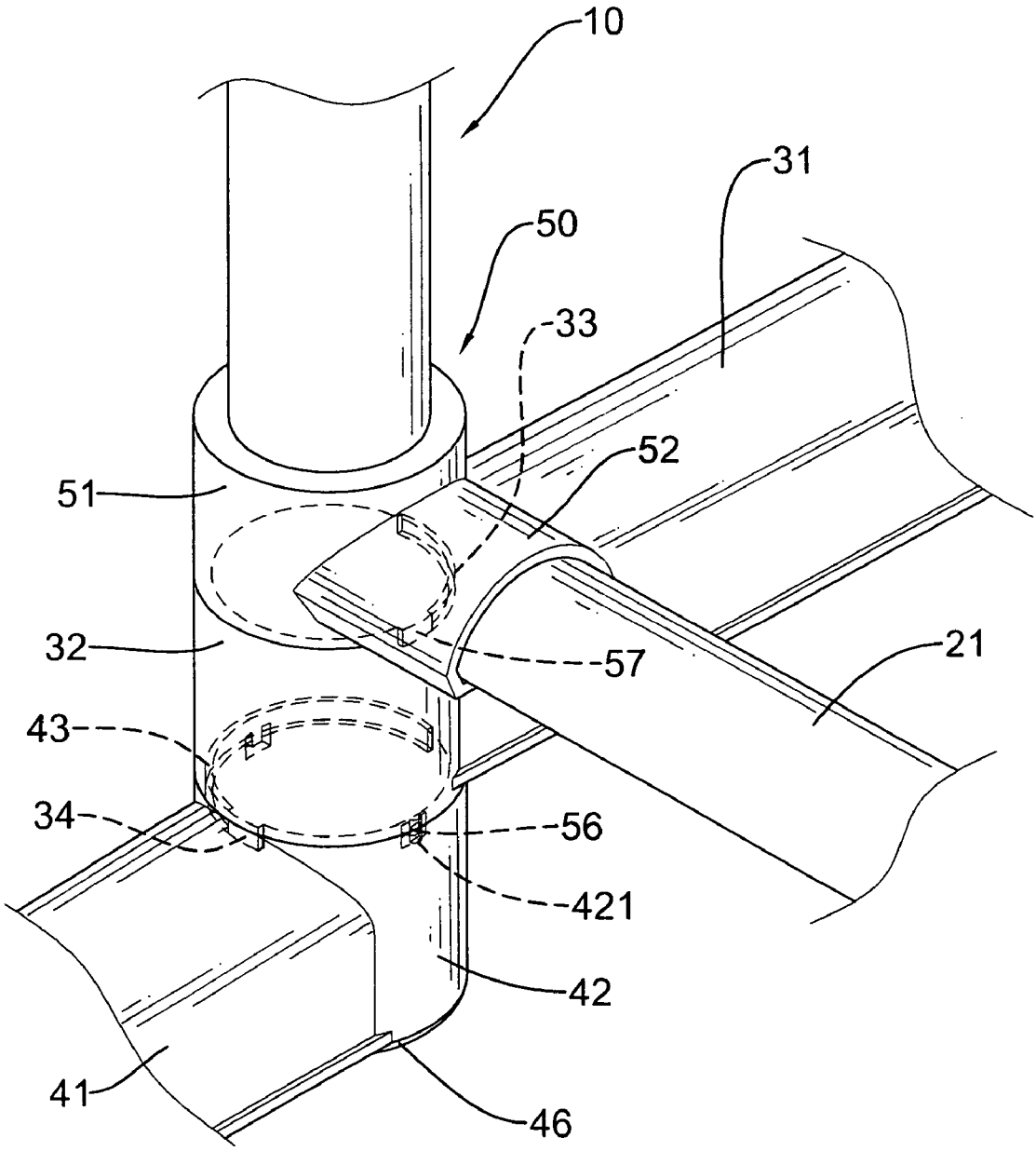
FIG. 3 is an enlarged perspective view showing the connection among the foot assembly, the stanchion and the crossbar of the clothes rack.

With reference to FIG. 3, when the foot assembly of the present invention is assembled, it is noted that the proximal end of the stanchion (10) is inserted into the third ring (51), the first ring (32) and the second ring (42) with the tubular extension (53) inserted into the first ring (32) and the second ring (42) as well. After the tubular extension (53) is inserted into the first ring (32) and the second ring (42), the second finger (57) is received in the first limiting recess (33) and the first finger (34) is received in the second limiting recess (43). Furthermore, when the flange (54) of the tubular extension (53) is inserted into the second ring (42), abutment of the flange (54) to the shoulder (44) forces the bottom edge of the tubular extension (53) to deform such that the flange (54) is able to extend over the shoulder (44) and then the same bottom edge springs back to lock with the second ring (42). Further, the positioning boss (56) is inserted and received in the slit (421) of the second ring (42). Finally, the plug (46) is inserted to cover the bottom opening of the second ring (42).

Figure 4:
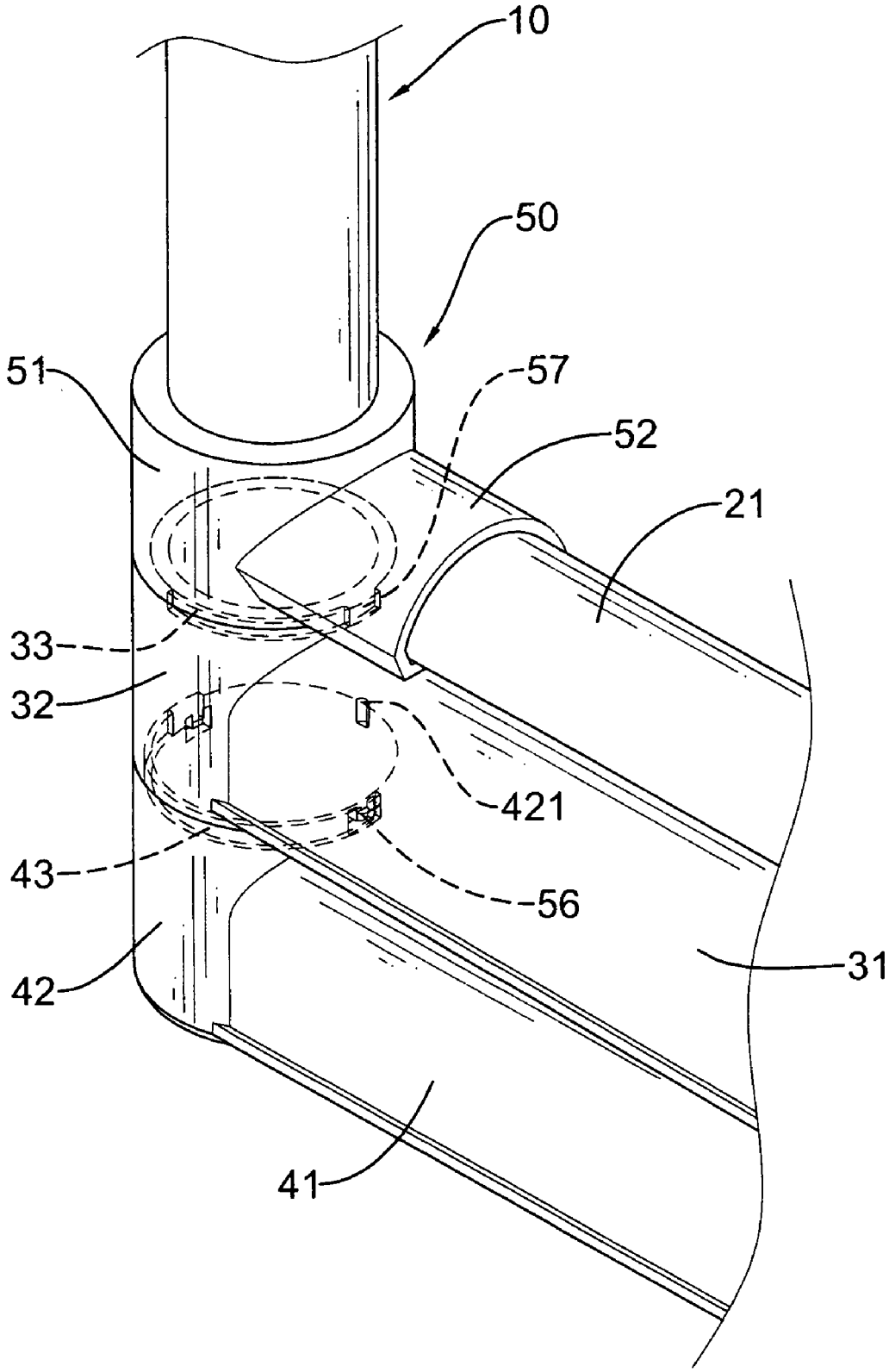
FIG. 4 is an enlarged perspective view showing that the foot assembly of the present invention is folded.
Figure 5:
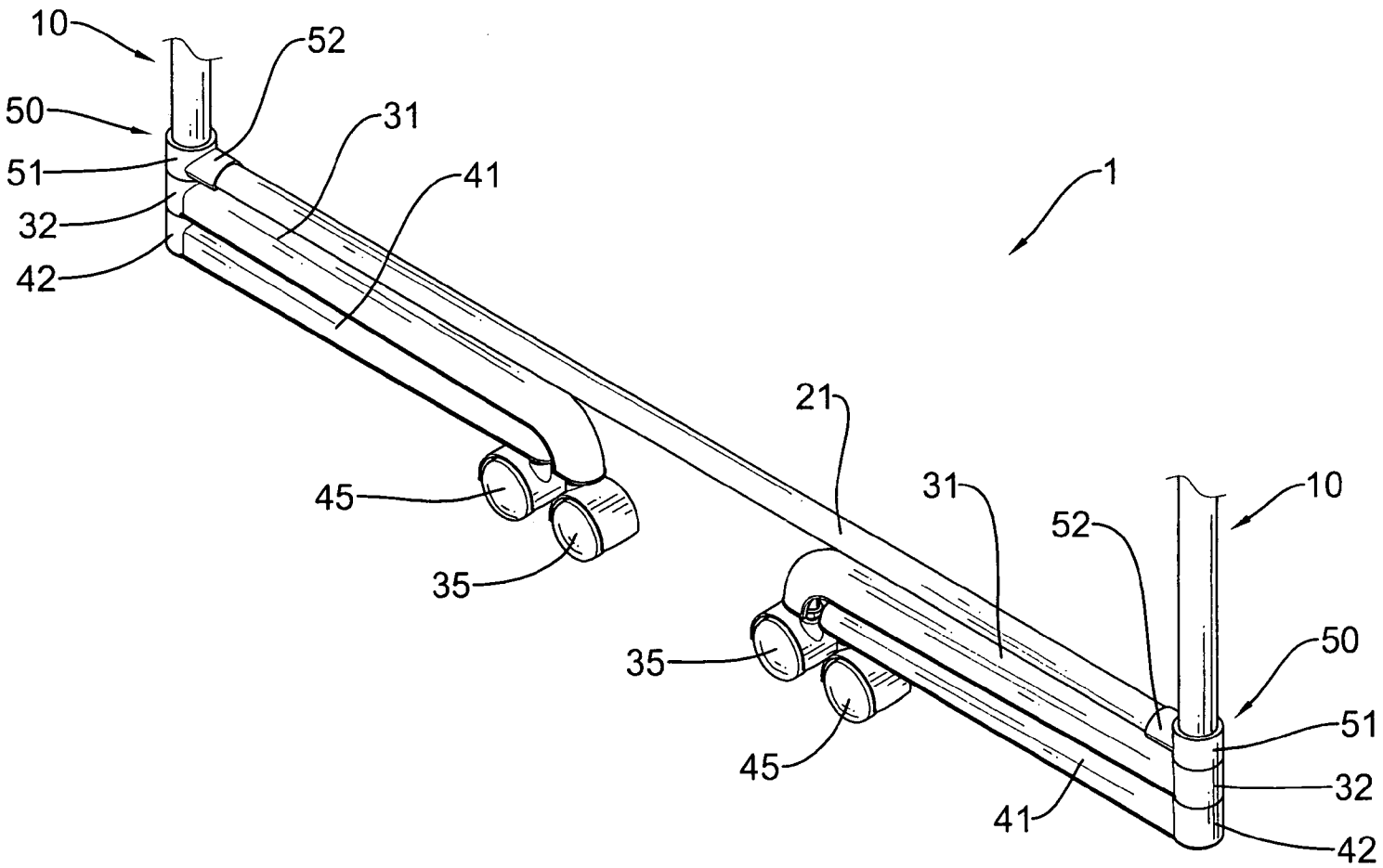
FIG. 5 is a perspective view showing that the foot assembly is folded to reduce storage space.
Figure 6:
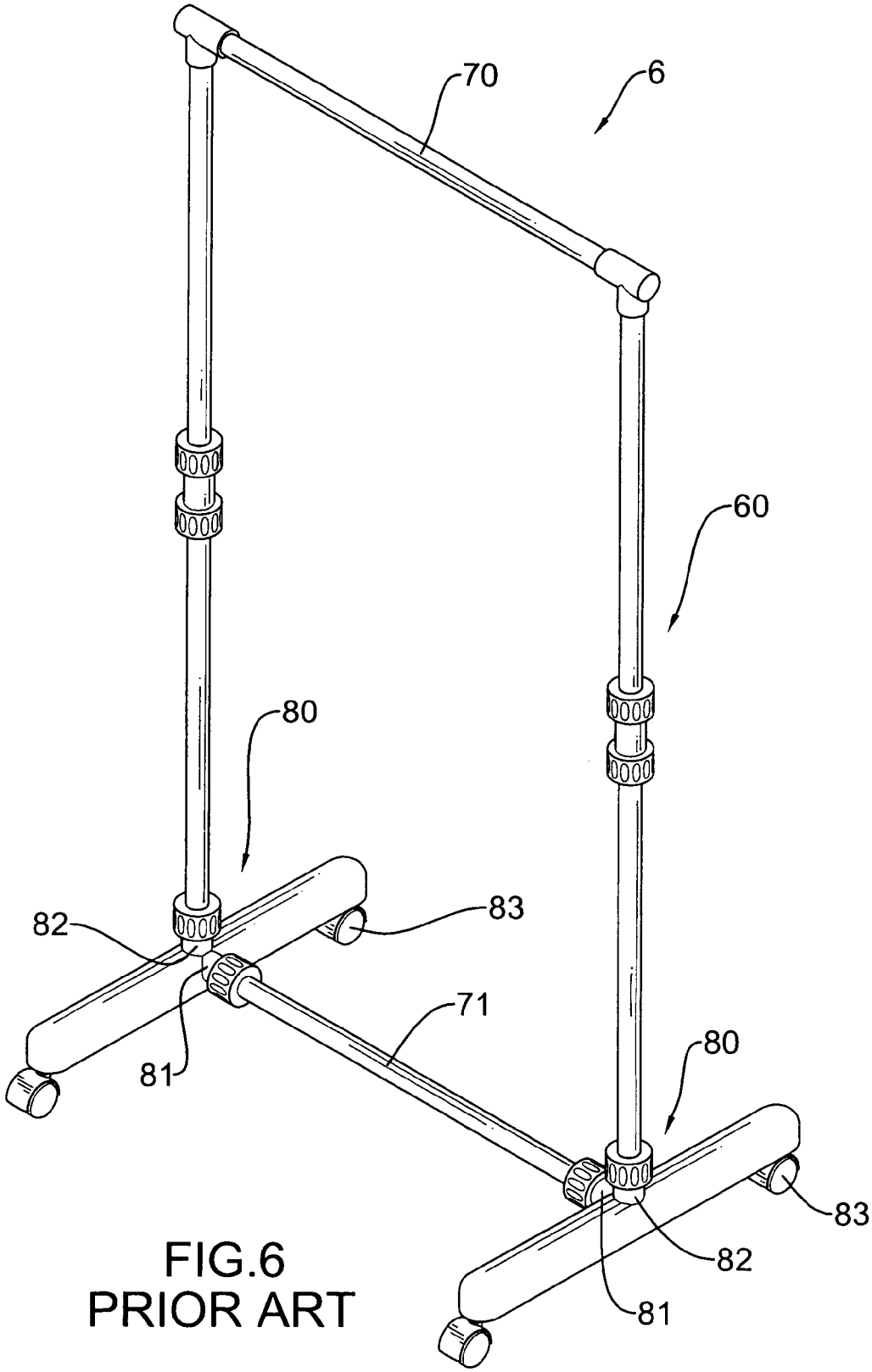
FIG.6 PRIOR ART
FIG. 6 is a perspective view of a conventional clothes rack.

With reference to FIGS. 4 and 5, when the clothes rack (1) of the present invention is to be folded for storage, the user is able to pivot the first leg (31) and the second leg (41) to align with each other. That is, due to the first finger (34) being received in the second limiting recess (43) and the second finger (57) being received in the first limiting recess (33), the first leg (31) is able to pivot relative to the second leg (41) and the second leg (41) is able to pivot relative to the first leg (31) to align with one another. While the second leg (41) is being pivoted, the positioning boss (56) will be forced out of the slit (421) by a periphery defining the slit (421) and when the second leg (41) is returned, the positioning boss (56) is again received in the slit (421) to temporarily lock the foot assembly of the present invention.

Because the first leg (31) and the second leg (41) are able to be pivoted so as to align with one another, the storage space required for the clothes rack is small and thus the user is able to use the available space effectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foot assembly for a clothes rack having a top crossbar, a bottom crossbar and two stanchions respectively and securely connected to two opposite ends of the top crossbar, the foot assembly comprising:

two first legs each having a first caster rotatably mounted on a distal end of the first leg and a first ring formed on a proximal end of the first leg and having a first limiting recess defined in an inner face of the first ring and a first finger extending from the inner face of the first ring;

two second legs each pivotally connected to a first leg and each having a second caster rotatably mounted on a distal end and each having a second ring formed on a proximal end of the second leg and having a second limiting recess defined in an inner face of each second ring to movably receive therein the first finger so as to limit the pivotal movement of the second legs relative to the first legs; and two joints each having a third ring for receiving distal ends of the two stanchions, a tube extending from an outer periphery of each third ring for receiving an end of the bottom crossbar and a tubular extension formed on a bottom rim of the third ring to extend into the first ring and the second ring, each joint having a second finger extending outward from an inner face of the third ring to be movably received in a corresponding first limiting recess such that the first legs are able to align with the second legs for storage and pivotal movement of the second legs relative to the first legs is limited.

2. The foot assembly as claimed in claim 1, wherein a flange is formed on a bottom rim of the tubular extension and having multiple cutouts longitudinally defined in a peripheral edge of the flange to allow the bottom rim of the tubular extension to be deformed when encountering a resistance, the second ring has a shoulder formed on the inner face of the second ring to abut and deform the bottom rim of the tubular extension and to allow the tubular extension to lock with the second ring after the bottom rim of the tubular extension is extended over the shoulder.

3. The foot assembly as claimed in claim 2, wherein a positioning boss is formed on an inner face of the tubular extension and the second ring has a slit corresponding to and receiving therein the positioning boss after the tubular extension is received in the second ring.

4. The foot assembly as claimed in claim 3, wherein the tubular extension has an outer diameter smaller than that of the third ring and an inner diameter the same as that of the third ring.

5. The foot assembly as claimed in claim 4, wherein the first limiting recess is defined in 90 degrees in the inner face of the first ring and the second limiting recess is defined in 180 degrees in the inner face of the second ring.

6. The foot assembly as claimed in claim 1, wherein the first tubular extnsion has an outer diameter smaller than that of the third ring and an inner diameter the same as that of the third ring.

* * * * *